United States Patent [19]

Hell

[11] 4,192,106

[45] Mar. 11, 1980

[54] MODULAR ELEMENTS FOR COMPOSING DISASSEMBLABLE WALLS, CABINETS, WRITING-DESKS OR OTHER PIECES OF FURNITURE

[75] Inventor: Hans Hell, Kassel, Fed. Rep. of Germany

[73] Assignee: Anonima Castelli S.p.A., Italy

[21] Appl. No.: 902,987

[22] Filed: May 4, 1978

[30] Foreign Application Priority Data

Jun. 24, 1977 [IT] Italy ..... 49978 A/77

[51] Int. Cl.[2] ..... A47G 29/02; A47H 5/00

[52] U.S. Cl. ..... 52/36; 52/239; 52/282; 160/135; 160/351

[58] Field of Search ..... 52/36, 70, 71, 239, 52/282, 580–584; 160/135, 351; 108/111, 129; 16/158, 149

[56] References Cited

U.S. PATENT DOCUMENTS

| | | | |
|---|---|---|---|
| 641,525 | 1/1900 | Lewis | 52/36 |
| 3,809,142 | 5/1974 | Bleeker | 160/135 |
| 4,059,058 | 11/1977 | Kazuhide | 108/129 |

FOREIGN PATENT DOCUMENTS

| | | | |
|---|---|---|---|
| 544122 | 1/1956 | Belgium | 52/584 |
| 2212645 | 9/1973 | Fed. Rep. of Germany | 52/584 |
| 399544 | 10/1933 | United Kingdom | 52/70 |

*Primary Examiner*—James L. Ridgill, Jr.
*Attorney, Agent, or Firm*—Staas & Halsey

[57] ABSTRACT

Modular elements for composing disassemblable walls, cabinets, writing tables and other pieces of furniture comprising:

panels;

box-like metal sections provided on three surfaces thereof with a groove defining a longitudinal slot of a width lower than that of the groove while from the remaining surface, anchoring means extend outwardly to connect each section to a panel;

column devices having, at its ends, pieces to be received inside the central grooves of said sections and cooperating with means for locking said pieces in its engaged position, said column housing a hollow tubular pivot member, into which passes a threaded rod having a upper control head and which at its lower end rests on an adjustable ground engaging foot;

cylindrical rods for the connection of wall panels, in coplanar relationship;

expansion screws to be inserted into the front grooves of the sections for carrying hooks, and the like;

hinge devices for the connection of adjacent wall panels at right angles and to allow said panels to be fold one on the other;

through rods passing from the top to the bottom through the vertical panels, and provided with a upper control head and with a lower adjustable ground engaging foot; and bars having shaped end portions, acting as spacers between two parallel panels.

5 Claims, 13 Drawing Figures

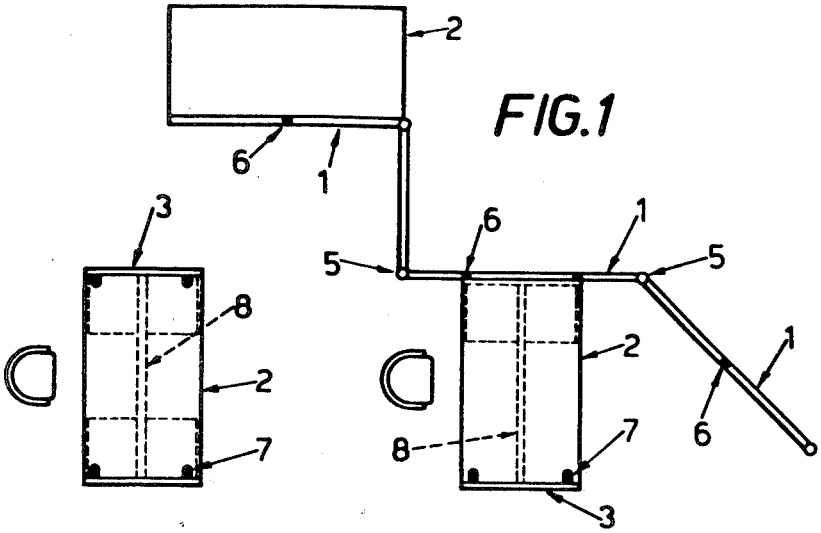
FIG.1
FIG.2
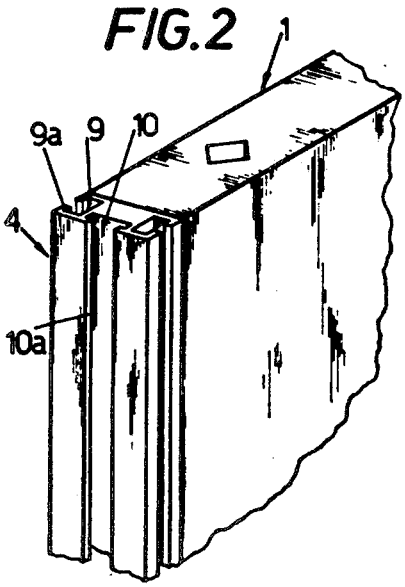
FIG.3
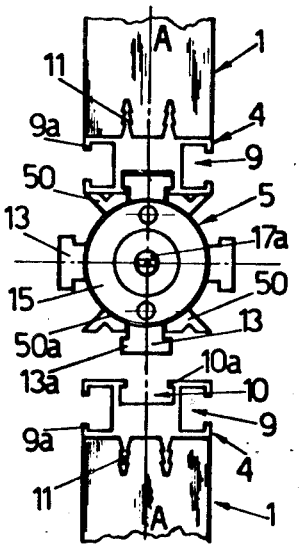

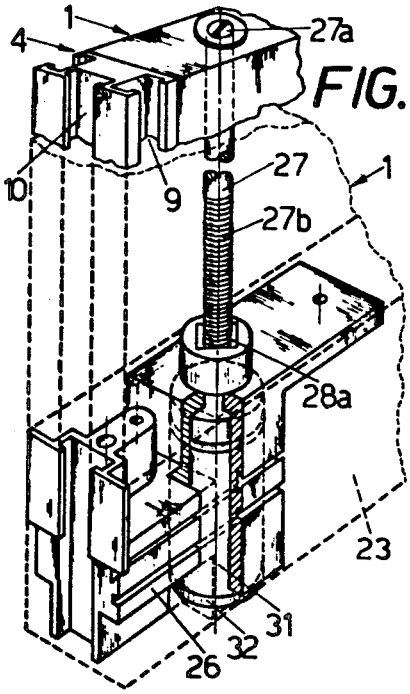
FIG.9
FIG.10
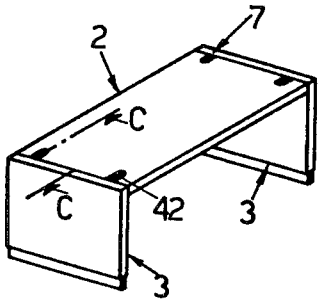
FIG.11a
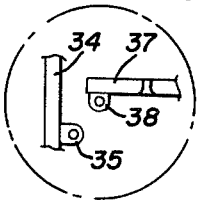
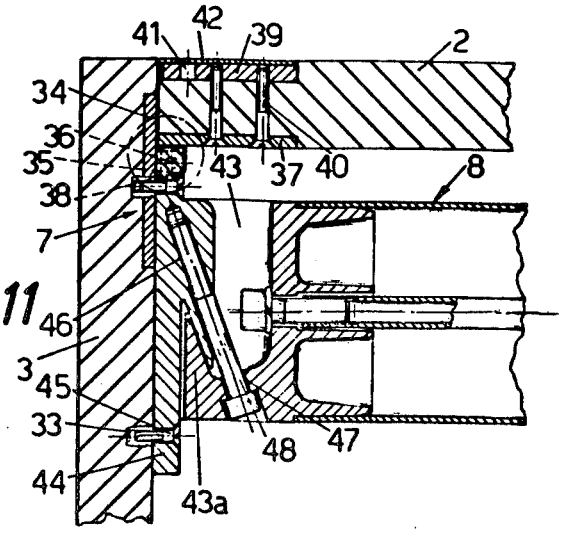
FIG.11

MODULAR ELEMENTS FOR COMPOSING DISASSEMBLABLE WALLS, CABINETS, WRITING-DESKS OR OTHER PIECES OF FURNITURE

The present invention concerns modular elements for composing rectilinear walls or walls extending with changes of directions, as well as cabinets, bookcases, writingdesks or similar pieces of furniture, and which can be easily disassembled and assembled again according to different patterns so as to divide a room in various sub-rooms or spaces having different intended purposes and each comprising the mainly necessary pieces of furniture, as shelves, bookcases, cabinets, writing-desks, tables and the like.

The invention provides a series of modular elements including:

panels of various standard sizes;

box-lixe sections made of metal, to be applied to at least two opposite edges of said panels, said sections on each of their parallel side surfaces and on one of the other side surfaces comprising a central longitudinal groove designed to receive screws or devices provided to connect two adjacent panels in coplanar arrangement or with a desired angle, while from the remaining side surface means extend outwardly for the connection of each section to the respective panel body;

column elements provided at their ends with means adapted to be received into the central longitudinal grooves of said box-like sections and allowing the adjacent panels to be connected to one another with the desired angle, said column elements cooperating with sealing means and with adjustable feet, which can be adjusted by acting on the upper end of said column elements;

rods connected to adjustable feet passing through the body of a panel within the thickness thereof and ending with upper control means;

expansion locking screws to be inserted in the front grooves of the box-like sections;

vertical shaped bars provided at their ends with engaging means for the connection of adjacent panels in coplanar relationship in co-operation with a pair of said box-like sections;

hinge means to connect adjacent panels at right angles; and shaped bars acting as spacing means to be mounted between two parallel panels and designed to be inserted into engaging seats of said panels in order to maintain the two panels parallel to one another.

In addition conventional auxiliary fittings will be used, in order to equip the structure with devices, such as table lamps, sockets or taps or the like used together with means, allowing said devices to be applied on the structure made of the modular elements of this invention or providing connections for the application of series of drawers, card-index boxes and the like.

Modular elements for obtaining equipped walls are already known in the art, elements which are commonly designed to subdivide a room in various spaces or sub-rooms having different intended purposes, but the already known systems are very complicated, require considerable space as well as the use of several different steel structural devices in order to allow to compose the various walls and pieces of furniture.

The present invention permits to compose walls with the use of few and very simple modular elements and with the use of a very limited number of locking and hinge means.

These and other characteristics and advantages of this invention will be better understood from the following description of an embodiment of this invention and taking in consideration the accompanying drawings, in which:

FIG. 1 is a top diagrammatic view of a configuration of walls and of pieces of furniture composed by means of the modular elements of the invention;

FIG. 2 is a perspective view of the detail of the end portion of a wall panel provided with a box-like section on its vertical side;

FIG. 3 is a top view of the detail of a column device for the connection between two panels and which enables the panels to be oriented according to any desired angle, one of said panels being already connected to the column device;

FIG. 9 is a perspective view (partly broken away) of a detail of the panel, shown in FIG. 7, and provided with an adjustable foot which can be controlled from the upper part of the panel and which passes through the thickness of this latter;

FIG. 10 is an enlarged perspective view of the writing-desk shown in FIG. 1;

FIG. 11 is a section of the table-top of the writing desk and of one of its sides, taken on the line C—C of FIG. 10;

FIG. 11*a* is an enlarged view of the hinge structure of FIG. 11; and

Figure 12:
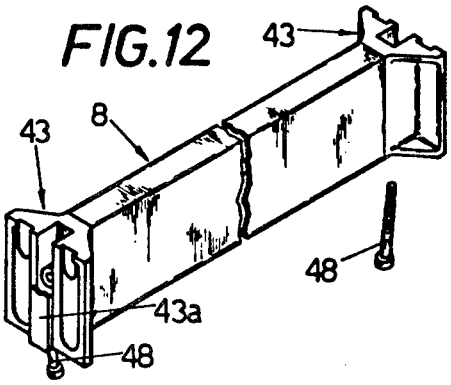

FIG. 12 is a perspective view of the beam (partly broken away) designed to hold the side panels of the writing-desk of FIGS. 1 and 10 in their parallel relationship.

Now referring to the drawings it is to be noted that the carrying structure is constituted of a plurality of panels made of chips covered with wood surfaces or of surfaces made of synthetic resin bonded laminate, said panels being constructed in a series of standard modular sizes according to their intended purposes.

The panels include: panels 1 designed to form the partition walls or the walls of cabinets or the like, and having a height equal to that of the partition walls to be obtained or equal to a submultiple of said heights; panels 2 to form the table-tops of writing-desks, tables or the like or the top walls of cabinets or the like; and panels 3 to form the sides of the writing-desks, tables or the like. At 4 are generally indicated metal sections designed to be applied along at least the vertical edges of the panels 1, and at 5 are generally indicated the column devices adapted to connect wall panels in any angular mutual position by means of end sections 4, while at 6 are indicated the devices for the connection of two wall panels 1 in aligned relationship. At 7 are indicated hinges provided to connect at right angles two panels 2 and 3 so as to construct a writing-desk, a table or the like in cooperation with a spacing bar, generally indicated by 8, or for forming angled walls for other intended purposes.

The hereinbefore mentioned elements are the main modular elements necessary for obtaining assemblable and disassemblable equipped walls or other pieces of furniture.

Now will be described in detail the single elements. Referring to an element 4 (see in particular FIGS. 2 and 3), this element is constituted of a section, preferably made of a light metal alloy, on two parallel sides of which a pair of grooves 9 are arranged of a rectangular cross section and having flanges 9*a* extending one towards the other so as to define therebetween a slot communicating with the outside.

The grooves 9 are designed to house expansion screws or the like, adapted to support hooks, small beams, shelves or brackets (which have not been shown in the drawings and which are of well known type).

On the outer surface of the section 4 a groove 10 is arranged similar to the grooves 9 and having flanges 10*a* extending one towards the other, while from the opposite side surface of said section extend outwardly toothed pins 11 designed to be inserted into the panel bodies 1 so as to lock the sections 4 to these latter sections 4, serving at the same time to screen the inner layers of the materials forming the panels 1.

For the connection of a panel 1 to another panel with any angle, a device 5 is provided, designed to be connected to the sections 4 as applied to the adjacent panels 1. The device 5 comprises a tubular hollow column 12 ending with a ring 12*a* made of plastic.

At the ends of the column 12, inside each of the rings 12*a* will be inserted the inner projecting arms of shaped pieces 13, each comprising a projecting outer part 13*a* having such a form as to be able to enter through its end orifice into the facing groove 10, of the adjacent section 4, and thus remaining locked therein.

On the outer end portion of the upper device 5 the pieces 13, 13*a* are locked between the ring 12*a* and an innerly threaded bushing 15 which will be screwed on the threaded tubular end portion 14*a* of an inner tubular body 14.

The tubular body 14 houses a vertical rod 17 made integral, at the upper end, with a control head 17*a*, while at its lower end the tubular body 14 is made integral with a bushing 18 along which a cylindrical foot 19 can slide having a double wall and on which rests the rod 17. Thus after the assembling of the wall, the foot 19 can be actuated so as to move it forwards so as to bring the respective wall in a correct vertical position, compensating for any uneveness of the floor and that is done acting with a tool on the head 17*a* of the rod 17. It results that the adjustment of the foot becomes easy since it can be performed from the top of the walls and that can be carried out also in the event that the panels 1 in question are a part of a cabinet or if one of the panels supports a writing table and the like.

The movement backwards of the foot 19 is performing owing to the wall weight.

The pieces 13, 13*a* are inserted and locked inside the grooves 10 of the sections 4. By releasing or removing the bushing 15 this latter will disengage said pieces 13 and 13*a*, afterwards a panel can be rotated with regard to another panel and be positioned according to the desired angle. Then the bushing 15 will be again locked to the device 5. Between the pieces 4 and the joining device 5 are also inserted packing pieces 50 which have a front cylindrical concave surface 50*a*, adapted to mate with the surface of the column 12, while at their back they form a projecting part mating with the shape of the grooves 10, inside which said projecting parts are received.

Figure 4:
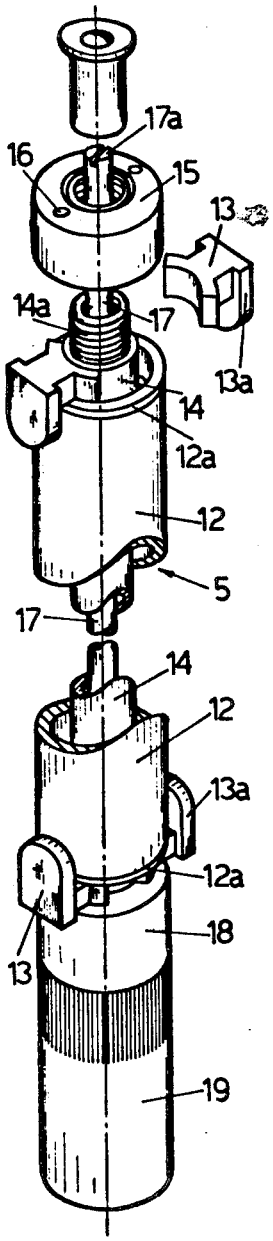
FIG. 4 is a perspective explosion view, partly broken away, of the column device shown in FIG. 3.
Figure 5:
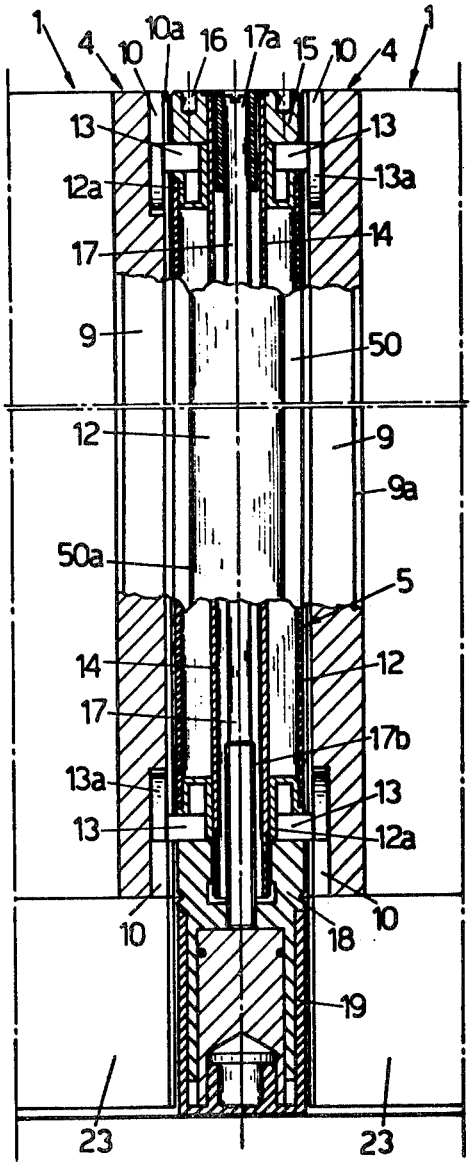
FIG. 5 is a vertical section partly broken away, showing the connection between two walls with the use of a column device, said section being taken on the line A—A of FIG. 3.
Figure 6:
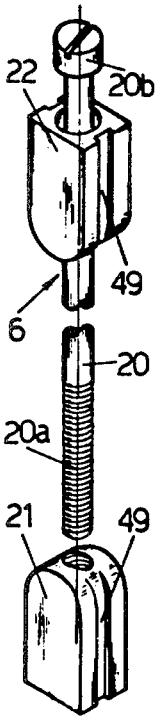
FIG. 6 is a perspective view, partly broken away, of the device provided to connect two walls in rectilinear relationship.
Figure 7:
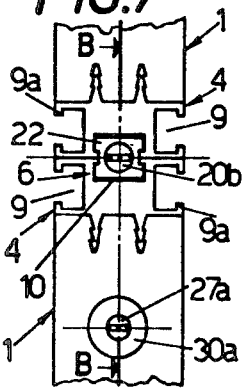
FIG. 7 is a top view of two wall panels connected to one another with the use of the device shown in FIG. 6.

In the event that two panels have to be connected in aligned relationship (FIG. 1) a simplier device 6 can be used (FIGS. 6 and 7) comprising a small rod 20 having a lower threaded portion 20*a*, said rod 20 entering a block 21 having an inner threaded hole designed to receive the threaded lower portion 20*a* of the rod 20 while at its upper end said rod 20 freely passes through a similar block 22, the hole of which, on the contrary, is not threaded.

The blocks 21 and 22 have shaped side surfaces so as to be inserted contemporaneously inside the two grooves 10 of the adjacent sections 4 which in this case are brought in contact end by end.

Therefore the blocks 21 and 22 have a pair of flattened faces of such a size as to respectively abut against the bottom of the grooves 10 of two sections, while in the other faces longitudinal grooves 49 (FIG. 6) are arranged adapted to contact the side surfaces of said groves 10 and to receive their flanges 10*a*, so that said blocks 21 and 22 after being inserted through the end orifices inside the grooves 10 of the adjacent sections 4, connect these latter together by means of the rod 20, which will be screwed into the block 21 acting on its upper control end 20*b*.

Figure 8:
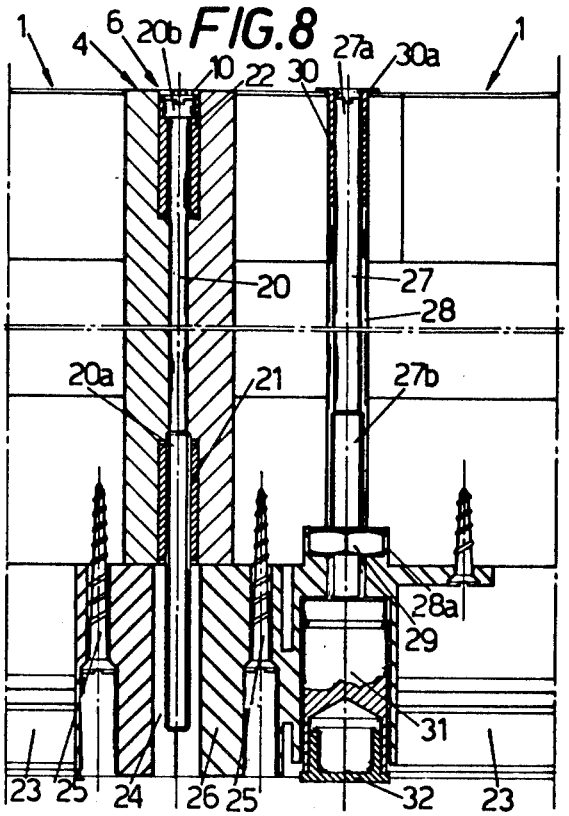
FIG. 8 is a vertical longitudinal section taken on the line B—B of FIG. 7 and partly broken away.

The disassemblable walls are preferably provided with a lower protection socle 23. In this case on the lower end of the said device 6 the rod 20 (FIG. 8) passes through the piece 21 and is received inside a ground-engaging foot 24 mounted inside a connection body 26 located between the adjacent socles 23 and fixedly connected to the panels 1 by means of screws 25. In the case, in which the panels 1 are connected in aligned relationship, the devices for compensating for horizontality defects of the floor can be constituted of a vertical through rod 27 (FIG. 8) having a control head 27*a* provided with an engaging slot on which a tool can be engaged, said rod 20 being threaded at least at its lower portion 27*b*. Said rod 27 passes through a vertical hole 28, arranged in the panel thickness and which near its lower part enlarges so as to form a hole of a larger diameter and which serves as a seat to receive a nut 29 screwed on the threaded rod 26 and acting as female thread body. At the upper part the rod 27 is supported and guided by a bushing 30 which at its upper end forms an outwardly extending flange 30*a*, by means of which it remains suspended to the top of the hole 28 (FIGS. 7 and 8), while at its lower part the rod 27 cooperates with a cylindrical body which houses a soft end body 32, the cylinder 31 being received inside a complementary hole arranged in the inserted piece 26, said hole having such a height to permit the ground engaging surface of the foot 32 to be aligned with the elements 23 or to extend outwardly beyond them. Thus in the event that at the point where two panels 1 are connected to another in aligned position, the floor presents a lack of flatness, the body 31 is caused to move forwards through the rod 27, acting on its head 27*a* to obtain the correctly horizontal positioning of the horizontal edges of the panels 1. The panels 1 can be used to form partitions of the subrooms. In this case they could embody doors or glazed frames and the like, or they could be used as bearing walls for shelves or for a table-top of a writing desk, for a table or the like which in this case, on its side adjacent to the wall could be carried by a beam, which at its ends is supported by expansion screws of a known type (not shown) and which are inserted inside the grooves 9 of the sections 4 fixed to a panel 1, from which said table-top 2 must be supported on one of its sides.

Now will be illustrated the system for composing a writing desk using panels 2 and 3. See FIGS. 10, 11 and 12.

The panels 2 and 3 are similar to the panels 1 with the exception of their sizes. On the panels 3 are arranged holes provided with innerly threaded bushings 33. At 7 is generally indicated a hinge device designed to allow the panels 2 and 3 to be connected at right angles or to be folded one on the other.

The hinge device 7 comprises a first plate 34 which will be embedded in the inner face of a panel 3 and which is integral with a tab 35 set at right angle, through which a hole is bored to receive a pivot pin 36, while 37 is a second plate (FIG. 11) partly embedded in the inner surface of the panel 2 and carrying a second tab 38 set at a right angle to the plate 37 and provided with a hole to receive the pivot pin 36.

The positioning of the tab 35 with regard to the plate 34 is such that when the plate 37 is positioned at right angle, it abuts and stops against the plate 34, while after a rotation thereof through an angle of 90° (in clockwise direction in FIG. 11), it can be set parallel to the plate 34 so that the panels 2 and 3 can be folded one on the other (position shown in broken line on the table as shown in FIG. 1), thus occupying a minimum space while keeping the panels 2 and 3 connected one to the other. At least the inner plate 37 cooperates with an outer parallel plate 39; said plates 37 and 39 are provided with coaxial holes to receive screws 40, thus permitting to firmly lock said second panel 2 to the hinge device since the panels have "per se" a very low strength. In the plate 39 other holes 41 can be provided for the fastening thereto of other various devices, as for instance, a table lamp, a box including gurrent taps, switches and the like. The plate 39 and the holes can be screened by a removable outer plate 42.

For the purpose of locking the panels 2 and 3 in their use position, in which they are set at right angles one to the other, a strong longitudinal beam is provided, generally indicated by 8 and having shaped end portions 43 adapted to permit the connection of each portion 43 to a plate 44 fixed by screws 45 to the inner surface of the respective panels 3.

The end portions 43 of the beam 8 are so shaped as to include hooking grooves complementary of shaped ribs provided on the plates 44. Said shaped end portions 43 are also each provided with an oblique hole 46 in register with a hole 47 arranged through a projecting part **43*a* of the end portion 43, said holes 46,47 being designed to receive a big screw 48**.

Thus after having applied the plates 44 to end panels 3, the beam 8 will be inserted by moving it up to bring the pair of holes 46, 47 in register. Then the safety locking screws 48, will be screwed therein. In the case in which one of the ends of the table top 2 of a writing desk is carried by a wall panel 1, in correspondence of which side no panel 3 will be provided and a plate 44 will be fixed to beam (not shown) designed to carrying the panel 2 constituting the table top of the writing table, the beam being supported by expansion screws engaged inside the grooves 9 of the sections 4 fixed at the side edges of the supporting panel 1 carrying the table top panel 2 of the writing table.

What we claim is:

1. Modular elements for composing walls, cabinets, writing tables and other pieces of furniture of a disassemblable type characterized by the fact that they comprise:

a kit including the following components;

panels of various standard sizes;

box-like metal sections designed to be applied to at least a pair of the opposite edges of said panels and provided on each of three surfaces thereof with a single longitudinal groove having a longitudinal slot access thereto of a width smaller than that of each of the grooves, while from the remaining fourth surface and designed to come into contact with the panel side anchoring means extend outwardly from the section so said anchoring means can connect the said section to the panel;

column devices to form a joining and pivoting connection for the panels, each having, at its ends, pieces adapted to be received inside the central longitudinal grooves of said sections, entering through the open end orifices thereof and cooperating with means locking said pieces in their engaged position, said solumn devices being covered by an elastically deformable material and housing in the inside a hollow tubular member into which passes a threaded rod having a upper control head and which at its lower end rests on an adjustable ground engaging foot;

cylindrical rods for the connection of wall panels, end by end in coplanar relationship, and provided with end pieces adapted to be received inside pairs of the central grooves of adjacent sections;

expansion locking screws to be inserted into the front grooves of the sections for carrying hooks, beams and the like;

hinge devices for the connection of adjacent wall panels at right angles and to allow said panels to be folded one on the other;

through rods passing through the vertical panels from the top to the bottom within the thickness thereof and provided with an upper control head and with a lower adjustable ground engaging foot; and bars having shaped end portions, acting as spacers between two parallel panels, said end portions being so shaped as to be received in seats arranged in shaped plates fixedly connected to the inner surfaces of said opposite wall panels and provided with through holes to receive safety locking screws.

2. Modular elements according to claim 1, wherein, the column devices include end pieces designed to be engaged in the central grooves of the sections which are fixed along the vertical edges of the adjacent panels, said column devices having an upper cap for frictionally connecting said pieces to the column device, said cap having a through hole through which passes the control head of the threaded rod in order to permit adjustment of the adjustable foot for compensating for unevenesses of the ground, packing means being also provided having a concave cylindrical surface facing the column and complementary to this latter so as to make a seal connection, said concave surface extending for an angular distance of about 90°, said pieces being connected to the sections by means of rearward extensions of a shape complementary to that of the central groove inside of which they are designed to be housed.

3. Modular elements according to claim 1, wherein the hinge devices for connecting two panels at right angles comprise a first plate having a tab extending perpendicularly to said plate, said tab having a hole therein to house a pivot pin, said tab being spaced away from the end of the plate more than the distance from the inner surface of the panel to which said first plate is fixedly connected and said first plate serves also as an abutment surface for a second plate, which is fixed to the second panel, said second plate has another tab including a through hole forming the second hinge element, so that said plates can rotate about the pivot axis through an angle of only 90° from the use position to their folded position and vice versa, at least one of said plates cooperating with another plate applied on the outer surface of the panel and provided with holes in register with those of said plate and designed to receive iron screws, the outer plate being screened by a removable covering plate.

4. Modular elements according to claim 1, wherein a writing desk table can be made by means of two identical panels forming the sides and a third panel forming the table top, said panels being connected to each other by said hinge devices, while on each of the inner surfaces of the two side panels shaped plates are fixed to receive the shaped end portion of the spacing bar, and acting in co-operation with safety locking screws.

5. A plurality of modular elements for composing walls, cabinets, writing tables and other pieces of furniture of a disassemblable type comprising:

at least five of the following in combination;

panels of various sizes;

rectangular metal sections for application to at least a pair of opposite edges of said panels, at least three surfaces of said metal sections having a single longitudinal groove provided therein with edge flanges defining a longitudinal slot of a width smaller than that of each groove for providing access thereto, the fourth surface of each of said metal sections being provided with anchoring means extending outwardly from the metal section for connecting each section to a panel;

column devices to form a joining and pivoting connection for the panels, each column device having pieces at the respective ends thereof for reception inside the longitudinal grooves of a connecting metal section and cooperating with means locking the pieces in their engaged positions, said column devices having mounted inside each thereof a hollow tubular member with a threaded rod therein having an upper control head thereon and the lower end of the hollow tubular member including an adjustable ground engaging foot;

cylindrical rods for connecting wall panels in end to end coplanar relationship, each of said cylindrical rods provided with end pieces adapted to be received inside pairs of the longitudinal grooves of adjacent sections;

expansion locking screws for insertion into grooves of the rectangular sections for carrying hooks, beams and the like;

hinge devices for connecting adjacent wall panels to allow said panels to be folded one on the other or open to each other at right angles to each other;

through rods passing through panels which are used vertically from the top to the bottom thereof and within the thickness thereof and provided with an upper control head and with a lower adjustable ground engaging foot; and spacer bars having shaped end portions for acting as supports between two parallel panels with said end portions being shaped to be received in seats arranged in shaped plates fixedly connected to the inner surfaces of said two parallel panels and provided with through holes to receive safety locking screws.

* * * * *